US011146004B2

(12) United States Patent
Yamaguchi et al.

(10) Patent No.: US 11,146,004 B2
(45) Date of Patent: Oct. 12, 2021

(54) CONNECTOR ASSEMBLY

(71) Applicant: Japan Aviation Electronics Industry, Ltd., Tokyo (JP)

(72) Inventors: Shuhei Yamaguchi, Tokyo (JP); Junji Oosaka, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 16/869,873

(22) Filed: May 8, 2020

(65) Prior Publication Data

US 2021/0005991 A1 Jan. 7, 2021

(30) Foreign Application Priority Data

Jul. 4, 2019 (JP) ..... JP2019-125075

(51) Int. Cl.
*H01R 12/00* (2006.01)
*H01R 12/71* (2011.01)
*H01R 12/70* (2011.01)

(52) U.S. Cl.
CPC ..... *H01R 12/716* (2013.01); *H01R 12/707* (2013.01); *H01R 12/714* (2013.01)

(58) Field of Classification Search
CPC .. H01R 12/716; H01R 12/714; H01R 12/707; H01R 12/73; H01R 12/712
(Continued)

(56) References Cited

U.S. PATENT DOCUMENTS 6,503,101 B1 * 1/2003 Yu ..... H01R 13/6597 439/607.36
8,888,506 B2 * 11/2014 Nishimura ..... H01R 43/24 439/74
(Continued)

FOREIGN PATENT DOCUMENTS

CN 104659569 A 5/2015
JP 2015-185541 A 10/2015
(Continued)

OTHER PUBLICATIONS

Korean Office Action corresponding application No. 10-2020-0062275 dated Jul. 6, 2021, with an English translation.
(Continued)

*Primary Examiner* — Abdullah A Riyami
*Assistant Examiner* — Nelson R. Burgos-Guntin
(74) *Attorney, Agent, or Firm* — Renner, Otto, Boisselle & Sklar, LLP

(57) ABSTRACT

A plug auxiliary fitting includes a plug side-wall facing portion facing a side surface of a plug housing. The plug side-wall facing portion includes a plug electrical connecting portion capable of coming into electrical contact with a receptacle auxiliary fitting, and a plug mating lock portion that cooperates with the receptacle auxiliary fitting to prevent a mating state between a plug connector and a receptacle connector from being released. The plug electrical connecting portion and the plug mating lock portion are, in a direction parallel to a plug-connector mounting surface of a plug-side board, adjacent to each other with a notch opened toward the plug-connector mounting surface of the plug-side board interposed therebetween. The plug mating lock portion is provided with a soldering portion solderable to the plug-connector mounting surface of the plug-side board.

10 Claims, 15 Drawing Sheets

(58) Field of Classification Search
USPC ..... 439/78
See application file for complete search history.

(56) References Cited

U.S. PATENT DOCUMENTS

| | | | | |
|---|---|---|---|---|
| 8,986,027 | B2 * | 3/2015 | Nishimura | H01R 12/707 439/181 |
| 2005/0032400 | A1 * | 2/2005 | Zhang | H01R 12/716 439/74 |
| 2005/0042924 | A1 * | 2/2005 | Zhang | H01R 13/6582 439/607.36 |
| 2006/0063432 | A1 * | 3/2006 | Chen | H01R 13/658 439/607.36 |
| 2006/0276061 | A1 * | 12/2006 | Koguchi | H01R 12/725 439/74 |
| 2008/0207014 | A1 * | 8/2008 | Takeuchi | H01R 12/716 439/74 |
| 2008/0305657 | A1 * | 12/2008 | Midorikawa | H01R 43/0235 439/74 |
| 2009/0061655 | A1 * | 3/2009 | Miyazaki | H01R 12/57 439/74 |
| 2010/0068900 | A1 * | 3/2010 | Wu | H01R 12/716 439/74 |
| 2011/0263140 | A1 * | 10/2011 | Sato | H01R 12/7052 439/74 |
| 2013/0012039 | A1 * | 1/2013 | Nose | H01R 12/716 439/74 |
| 2015/0079816 | A1 * | 3/2015 | Suzuki | H01R 12/7082 439/74 |
| 2015/0140840 | A1 * | 5/2015 | Nishimura | H01R 13/6594 439/74 |
| 2015/0140841 | A1 * | 5/2015 | Watanabe | H01R 43/18 439/74 |
| 2015/0207248 | A1 * | 7/2015 | Takenaga | H01R 13/6582 439/74 |
| 2015/0270641 | A1 | 9/2015 | Omodachi et al. | |
| 2016/0036145 | A1 * | 2/2016 | Hasegawa | H01R 12/716 439/78 |
| 2016/0190719 | A1 * | 6/2016 | Brzezinski | H01R 12/73 439/74 |
| 2020/0044374 | A1 * | 2/2020 | Ishida | H01R 12/721 |

FOREIGN PATENT DOCUMENTS

| | | |
|---|---|---|
| KR | 10-2015-0057943 | 5/2015 |
| KR | 10-2018-0112359 | 10/2018 |

OTHER PUBLICATIONS

Chinese Office Action corresponding application No. 202010425980.5 dated Jul. 26, 2021, with an English translation.

* cited by examiner

CONNECTOR ASSEMBLY

INCORPORATION BY REFERENCE

This application is based upon and claims the benefit of priority from Japanese patent application No. 2019-125075, filed on Jul. 4, 2019, the disclosure of which is incorporated herein in its entirety by reference.

BACKGROUND

The present disclosure relates to a connector assembly.

Patent Literature 1 (Japanese Unexamined Patent Application Publication No. 2015-185541) discloses, as shown in FIG. 13 of the present disclosure, a connector assembly 102 including a receptacle connector 100 to be mounted on a circuit board, and a plug connector 101 to be mounted on another circuit board.

The receptacle connector 100 includes a plurality of receptacle terminals 103 arranged in two rows, a receptacle housing 104 holding the plurality of receptacle terminals 103, and two receptacle fittings 105 respectively attached to the end portions of the receptacle housing 104 in the longitudinal direction.

The plug connector 101 includes a plurality of plug terminals 106 arranged in two rows, a plug housing 107 holding the plurality of plug terminals 106, and two plug fittings 108 respectively attached to the end portions of the plug housing 107 in the longitudinal direction.

With the above configuration, when the plug connector 101 is mated with the receptacle connector 100, the plug housing 107 is accommodated in the receptacle housing 104, and each plug terminal 106 and each receptacle terminal 103 are electrically connected to each other. In addition, each plug fitting 108 and each receptacle fitting 105 are electrically connected to each other and function to lock the mating between the plug connector 101 and the receptacle connector 100.

FIG. 14 of the present disclosure shows an enlarged receptacle fitting 105. As shown in FIG. 14, the receptacle fitting 105 includes two inner-surface portions 110. Each inner-surface portion 110 is formed in a cantilever manner and extends in the longitudinal direction of the receptacle connector 100. Each inner-surface portion 110 is provided with a locking raised portion 111 formed by lancing.

FIG. 15 of the present disclosure shows an enlarged plug fitting 108. As shown in FIG. 15, the plug fitting 108 includes two first outer-surface portions 112 and two second outer-surface portions 113.

Each first outer-surface portion 112 is used as a terminal to be electrically connected with a power source of a circuit board or the like.

Each second outer-surface portion 113 is arranged to face each inner-surface portion 110 when the plug connector 101 is mated with the receptacle connector 100. In addition, each second outer-surface portion 113 is provided with a projection portion 114. Thus, when the plug connector 101 is mated with the receptacle connector 100, the projection portion 114 of each second outer-surface portion 113 of the plug fitting 108 shown in FIG. 15 cooperate with the raised portion 111 of each inner-surface portion 110 of the receptacle fitting 105 shown in FIG. 14 to perform a function of locking the mating between the plug connector 101 and the receptacle connector 100.

SUMMARY

With the configuration in Patent Literature 1, there is room for improvement in the mating lock function.

An object of the present disclosure is to provide a technique for achieving a stable mating lock function while securing electrical connection between auxiliary fittings.

According to an aspect of the present disclosure, there is provided a connector assembly including a first connector including a plurality of first contacts, a first housing holding the plurality of first contacts, and a first auxiliary fitting attached to the first housing, the first connector being mountable on a first circuit board, and a second connector including a plurality of second contacts, a second housing holding the plurality of second contacts, and a second auxiliary fitting attached to the second housing, the second connector being mountable on a second circuit board. The first connector is mated with the second connector to bring each first contact into electrical contact with each second contact. The first auxiliary fitting includes a first side-surface facing portion facing a side surface of the first housing. The first side-surface facing portion includes a first electrical connecting portion capable of coming into electrical contact with the second auxiliary fitting, and a first mating lock portion that cooperates with the second auxiliary fitting to prevent a mating state between the first connector and the second connector from being released. The first electrical connecting portion and the first mating lock portion are, in a direction parallel to a first connector mounting surface of the first circuit board, adjacent to each other with a gap opened toward the first connector mounting surface of the first circuit board interposed therebetween. The first mating lock portion is provided with a soldering portion solderable to the first connector mounting surface of the first circuit board.

According to the present disclosure, since the first mating lock portion is provided with the soldering portion, it is possible for the first mating lock portion to stably perform a mating lock function. In addition, the gap makes it difficult for solder flux crawling up the soldering portion to reach the first electrical connecting portion, therefore a stable electrical connection at the first electrical connecting portion is achieved.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Hereinafter, embodiments of the present disclosure will be described with reference to the drawings.

Figure 1:
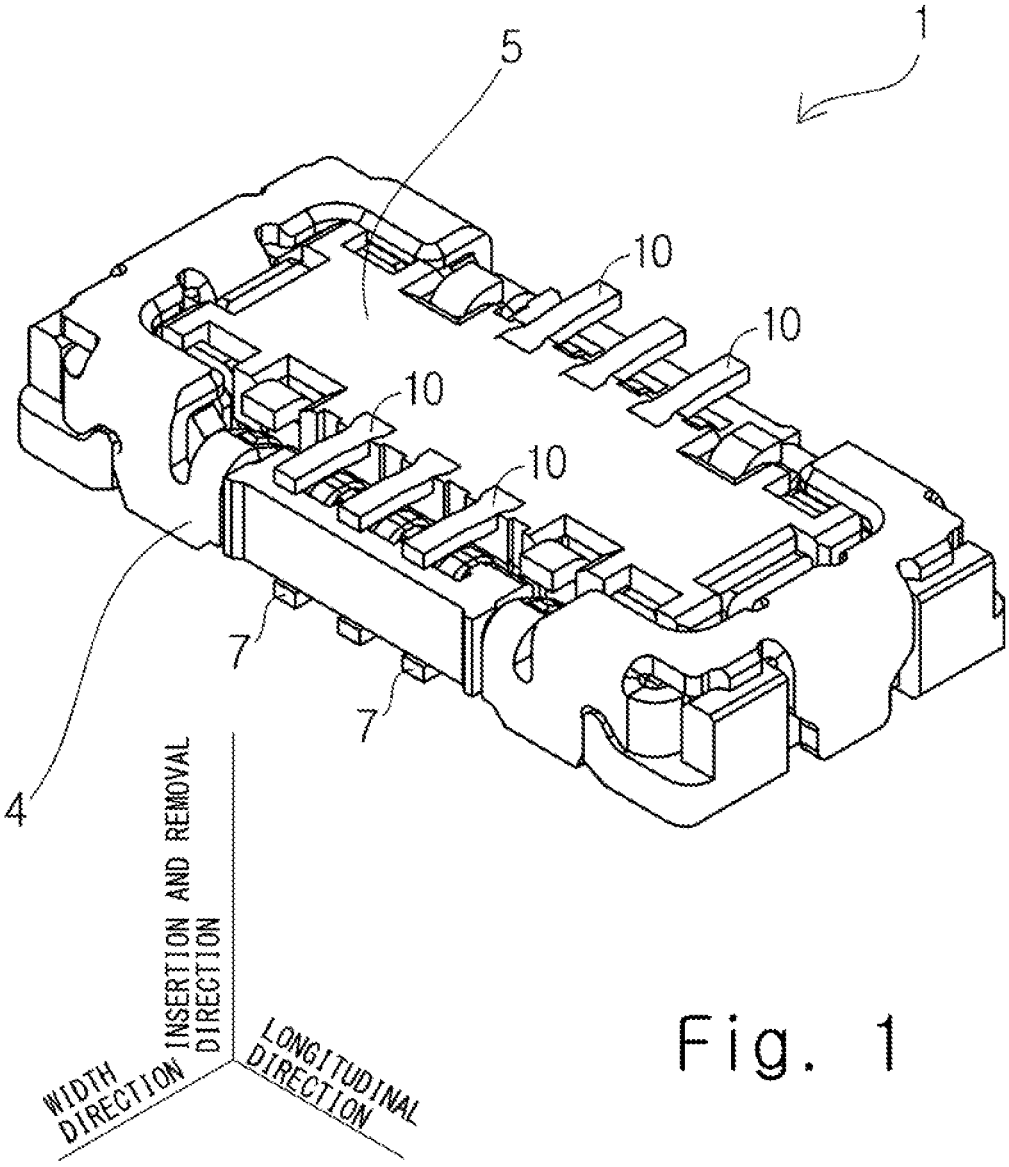
FIG. 1 is a perspective view of a connector assembly in a mating state.
Figure 2:
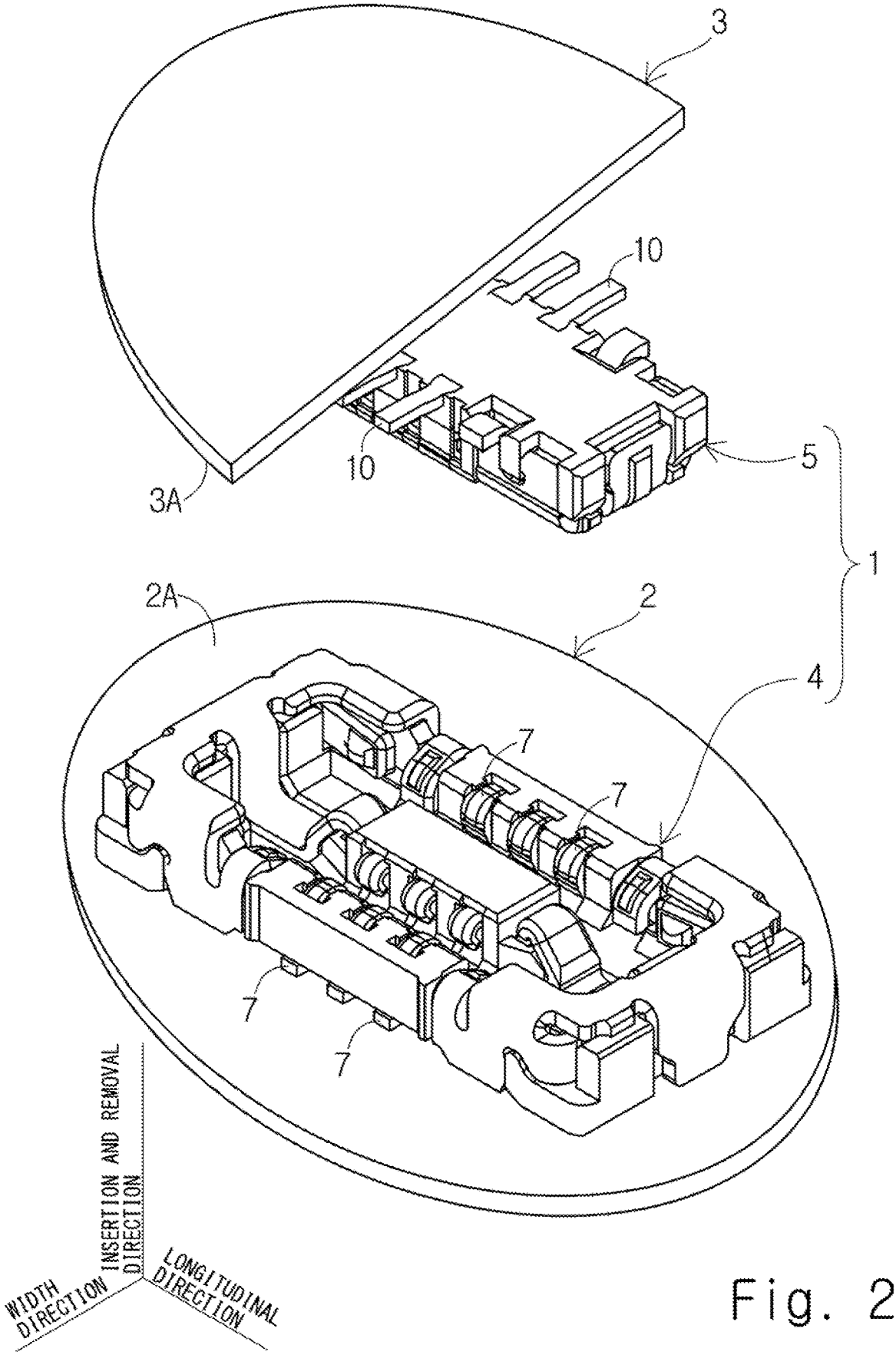
FIG. 2 is a perspective view of a plug connector and a receptacle connector before they are mated with each other.

As shown in FIGS. 1 and 2, a connector assembly 1 electrically and mechanically connects a receptacle side board 2 (a second circuit board) and a plug-side board 3 (a first circuit board).

The receptacle side board 2 and the plug-side board 3 are, for example, printed circuit boards (PCB), printed wiring boards (PWB), flexible printed circuits (FPC), or flexible flat cables (FFC), but are not limited to these.

The connector assembly 1 includes a receptacle connector 4 (a second connector) to be mounted on a receptacle-connector mounting surface 2A (a second connector mounting surface) of the receptacle side board 2, and a plug connector 5 (a first connector) to be mounted on a plug-connector mounting surface 3A (a first connector mounting surface) of the plug-side board 3.

Figure 3:
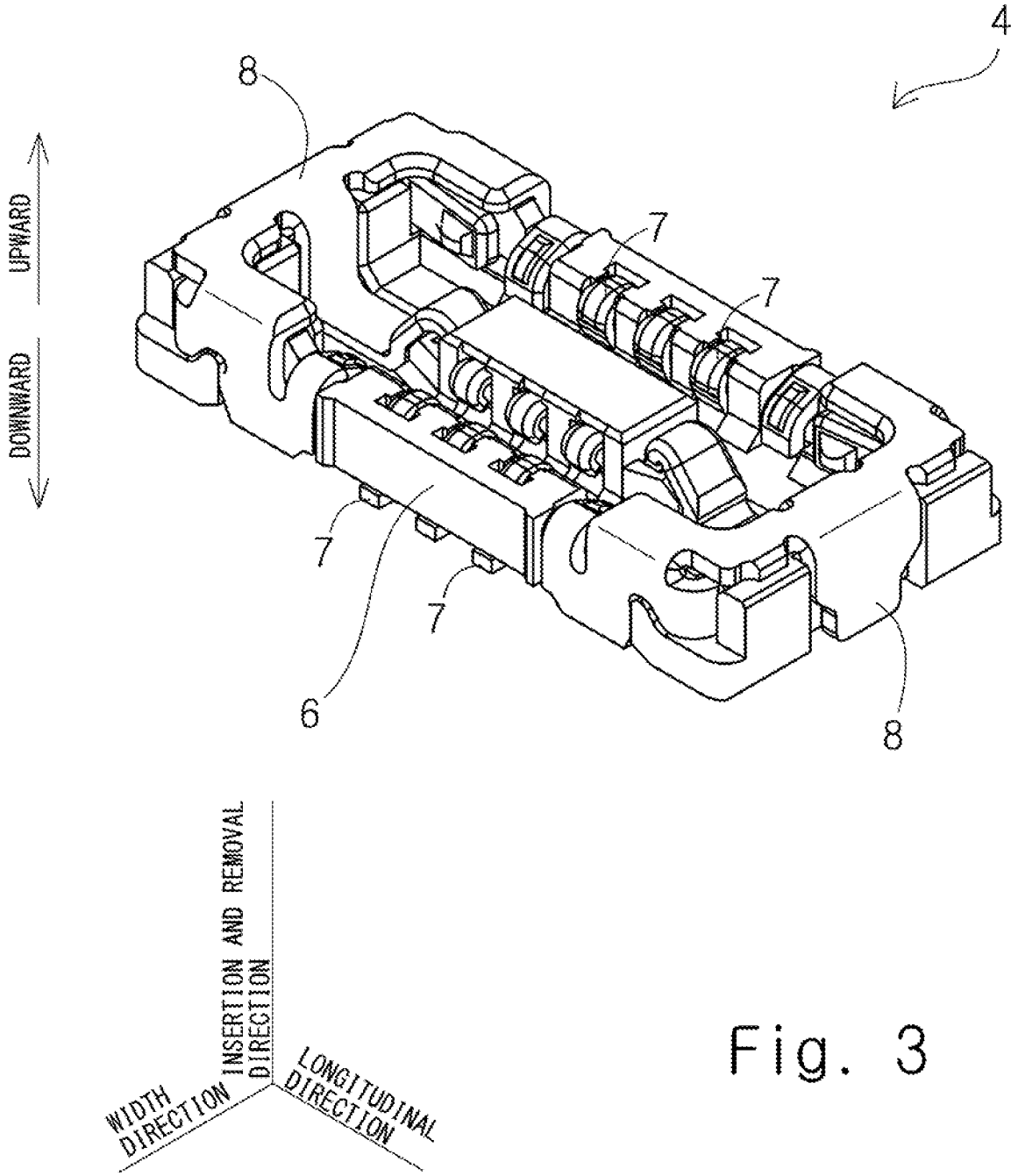
FIG. 3 is a perspective view of the receptacle connector.
Figure 4:
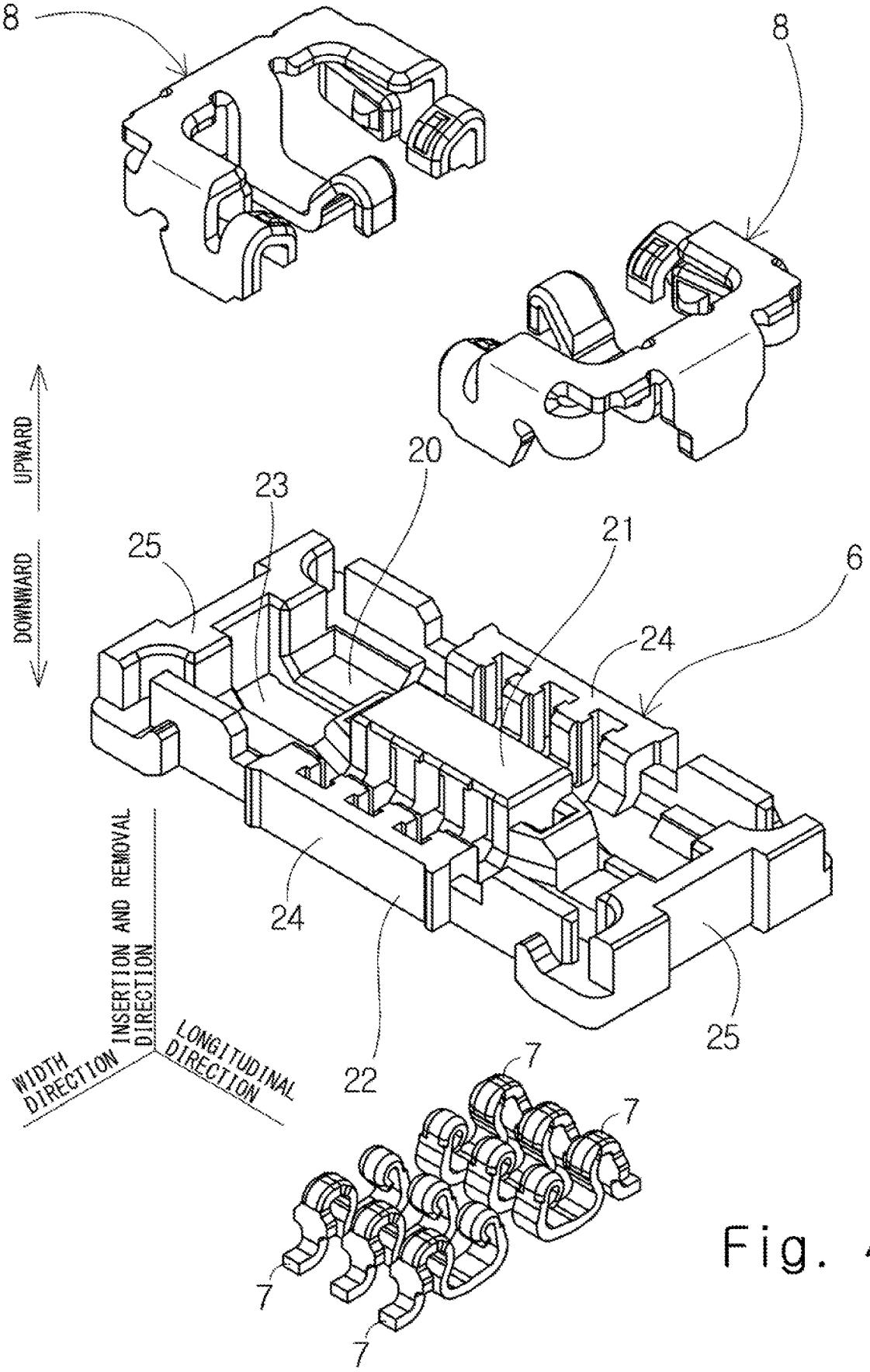
FIG. 4 is an exploded perspective view of the receptacle connector.

As shown in FIGS. 3 and 4, the receptacle connector 4 includes a receptacle housing 6 (a second housing), a plurality of receptacle contacts 7 (second contacts), and two receptacle auxiliary fittings 8 (second auxiliary fittings).

Figure 8:
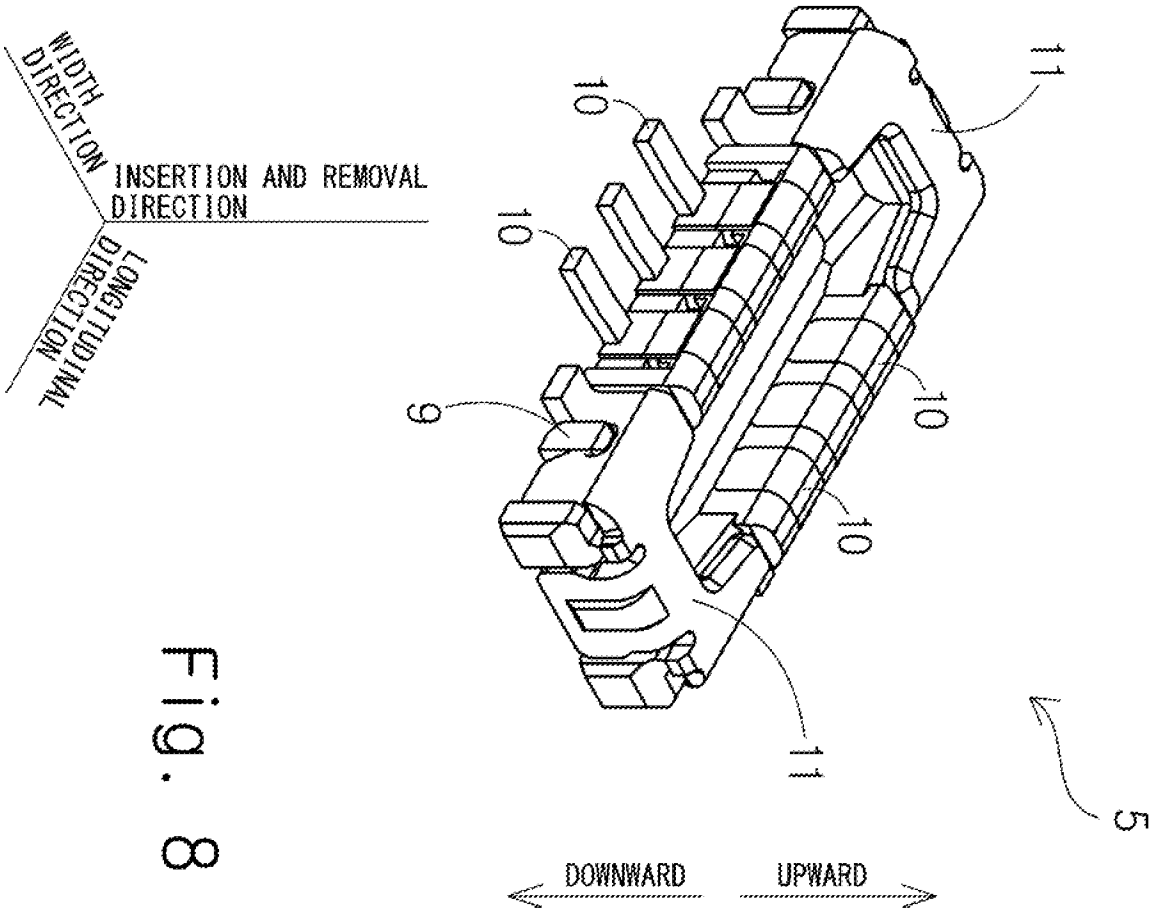
FIG. 8 is a perspective view of the plug connector.
Figure 9:
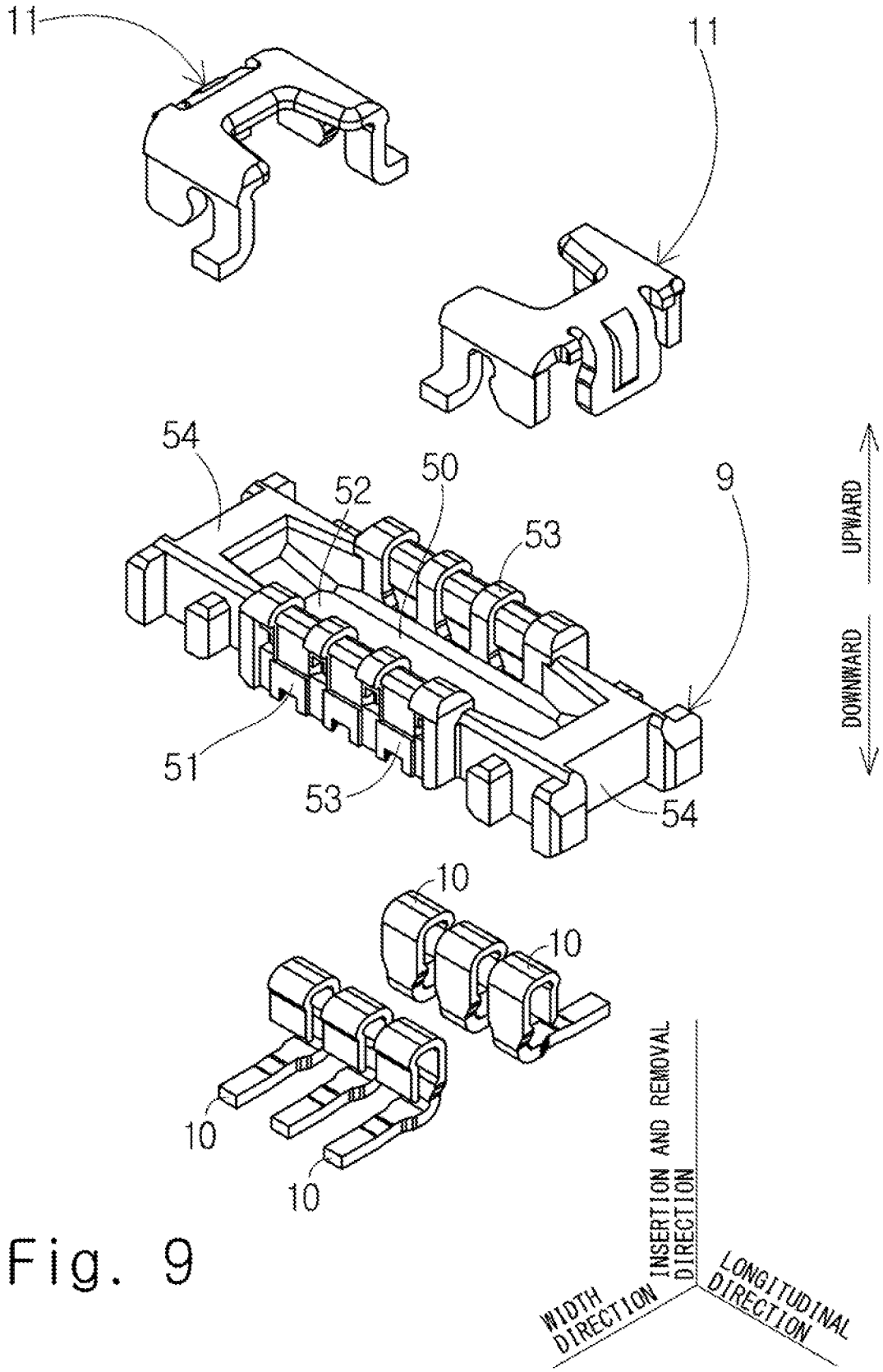
FIG. 9 is an exploded perspective view of the plug connector.

As shown in FIGS. 8 and 9, the plug connector 5 includes a plug housing 9 (a first housing), a plurality of plug contacts 10 (first contacts), and two plug auxiliary fittings 11 (first auxiliary fittings).

When the plug connector 5 is mated with the receptacle connector 4 as shown in FIG. 1 from the state in which the receptacle connector 4 is facing the plug connector 5 as shown in FIG. 2, each of the receptacle contacts 7 comes into electrical contact with each of the plug contacts 10.

In addition, when the plug connector 5 is mated with the receptacle connector 4 as shown in FIG. 1, each of the receptacle auxiliary fittings 8 in FIG. 3 comes into electrical contact with each of the plug auxiliary fittings 11 in FIG. 8, and they perform, in cooperation, a function of preventing the mating state between the receptacle connector 4 and the plug connector 5 from being released. In the following description, the function for preventing the mating state between the receptacle connector 4 and the plug connector 5 from being released is referred to as a mating lock function.

(Definition of Each Direction)

Here, with reference to FIGS. 1 and 2, the terms "longitudinal direction", "insertion and removal direction", and "width direction" are defined.

(Definition of Each Direction: Longitudinal Direction)

As shown in FIGS. 1 and 2, the plurality of receptacle contacts 7 of the receptacle connector 4 are arranged in two rows. The direction in which the receptacle contacts 7 belonging to one of the two rows are adjacent to each other is defined as the longitudinal direction of the connector assembly 1. In the following, the longitudinal direction basically means the longitudinal direction of the connector assembly 1.

The longitudinal direction includes a longitudinal center direction and a longitudinal end direction. The longitudinal center direction is a direction toward the center of the connector assembly 1 in the longitudinal direction. The longitudinal end direction is a direction away from the center of the connector assembly 1 in the longitudinal direction.

(Definition of Each Direction: Insertion and Removal Direction)

As shown in FIGS. 1 and 2, the direction in which the plug connector 5 is mated with the receptacle connector 4 and the plug connector 5 is removed from the receptacle connector 4 is defined as the insertion and removal direction of the connector assembly 1. In the following, the insertion and removal direction basically means the insertion and removal direction of the connector assembly 1.

The insertion and removal direction includes the mating direction and the removing direction. The mating direction is the direction in which the plug connector 5 is moved toward the receptacle connector 4 in order for the plug connector 5 to be mated with the receptacle connector 4. The removing direction is the direction opposite to the mating direction, and is the direction in which the plug connector 5 is separated away from the receptacle connector 4 in order for the plug connector 5 to be removed from the receptacle connector (Definition of Each Direction: Width Direction)

The width direction is the width direction of the connector assembly 1 and perpendicular to the longitudinal direction and the insertion and removal direction.

The width direction includes the inward direction and the outward direction. The inward direction is the direction toward the center of the connector assembly 1 in the width direction. The outward direction is the direction away from the center of the connector assembly 1 in the width direction.

(Definition of Each Direction: Others)

In the following, when the receptacle connector 4 is described with reference to FIGS. 3 to 7, the mating direction is replaced with "downward", and the removing direction is replaced with "upward" for the sake of explanation. Thus, when, for example, an "upper surface" is mentioned with reference to FIGS. 3 to 7, the mentioned surface is the surface facing in the removing direction.

On the other hand, when the plug connector 5 is described with reference to FIGS. 8 to 12, the mating direction is replaced with "upward", and the removing direction is replaced with "downward" for the sake of explanation. Thus, when, for example, an "upper surface" is mentioned with reference to FIGS. 8 to 12, the mentioned surface is the surface facing in the mating direction.

In this manner, when the receptacle connector 4 and the plug connector 5 are specifically described, the terms "upward" and "downward" are exchanged depending on the related drawings.

(Receptacle Connector 4)

With reference to FIGS. 3 to 7, the receptacle connector 4 will be specifically described below.

As shown in FIGS. 3 and 4, the receptacle connector 4 includes, as described above, the receptacle housing 6, the plurality of receptacle contacts 7, and the two receptacle auxiliary fittings 8.

As shown in FIG. 4, the receptacle housing 6 is made of insulation resin, and is formed to be elongated in the longitudinal direction. The receptacle housing 6 includes a bottom wall 20, an island portion 21, and a peripheral wall 22.

The bottom wall 20 is a wall portion having a rectangular shape in plan view, and extends in the longitudinal direction.

The thickness direction of the bottom wall 20 is equal to the insertion and removal direction.

The island portion 21 projects in an island shape from the center of the bottom wall 20 in the longitudinal direction and the width direction.

The peripheral wall 22 projects upward from the rim of the bottom wall 20 to surround the island portion 21 in plan view. Thus, between the island portion 21 and the peripheral wall 22, a rectangular doughnut-shaped plug accommodating space 23 is formed.

The peripheral wall 22 includes two receptacle-contact holding portions 24, and two receptacle-auxiliary-fitting holding portions 25.

Each of the receptacle-contact holding portions 24 holds three receptacle contacts 7 and faces the island portion 21 in the width direction.

Each of the receptacle-auxiliary-fitting holding portions 25 holds each of the receptacle auxiliary fittings 8, and is adjacent to the receptacle-contact holding portions 24 in the longitudinal direction.

Figure 5:
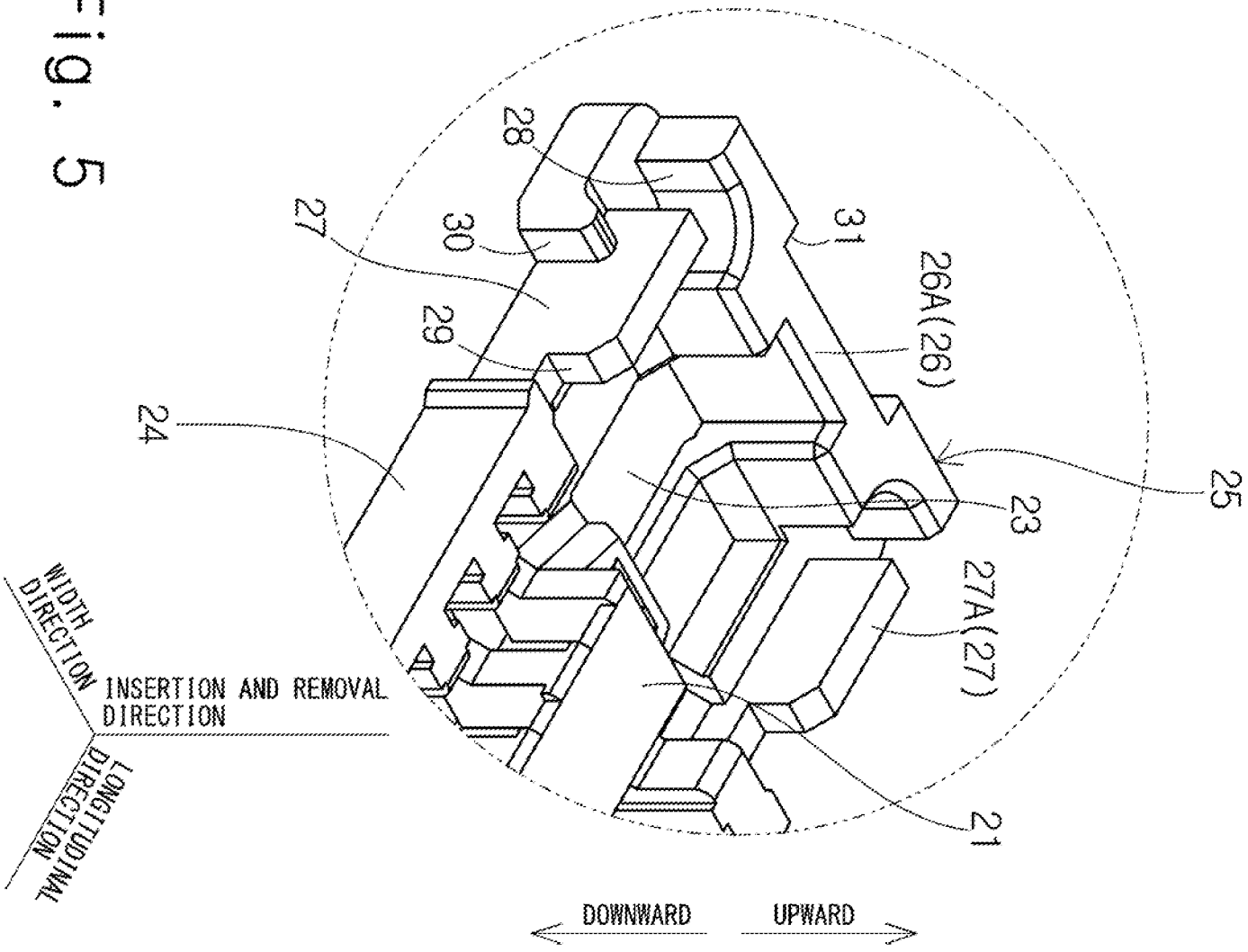
FIG. 5 is an enlarged partial perspective view of a receptacle housing.

As shown in FIG. 5, each of the receptacle-auxiliary-fitting holding portions 25 includes a receptacle-auxiliary-fitting holding end-portion 26 facing the island portion 21 in the longitudinal direction, and two receptacle-auxiliary-fitting holding side-portions 27 facing each other in the width direction, and forms a U-shape opened in the longitudinal center direction in plan view.

Between the receptacle-auxiliary-fitting holding end-portion 26 and each of the receptacle-auxiliary-fitting holding side-portions 27, a receptacle-contact-portion accommodating slit 28 opened upward is formed. Between each of the receptacle-auxiliary-fitting holding side-portions 27 and each of the receptacle-contact holding portions 24, a receptacle lock portion accommodating slit 29 opened upward is formed. The receptacle-auxiliary-fitting holding end-portion 26 includes an upper surface 26A. Similarly, each of the receptacle-auxiliary-fitting holding side-portions 27 includes an upper surface 27A.

Each of the receptacle-auxiliary-fitting holding portions 25 is formed with two receptacle-auxiliary-fitting press-fitting grooves 30 and one auxiliary-fitting inserting groove 31.

As shown in FIGS. 3 and 4, the plurality of receptacle contacts 7 are made of metal, and arranged in two rows as described above. The receptacle contacts 7 belonging to one of the two rows are each arranged from one of the receptacle-contact holding portions 24 of the receptacle housing 6 to the island portion 21 across the plug accommodating space 23.

Each of the receptacle contacts 7 can be manufactured by punching and bending a metal plate, but is not limited thereto. Each of the receptacle contacts 7 is integrated with the receptacle housing 6 by insert-molding, but is not limited thereto, and may be attached to the receptacle housing 6 by press-fitting.

Note that, the plurality of receptacle contacts 7 are arranged in two rows in the present embodiment, but are not limited thereto. For example, the plurality of receptacle contacts 7 may be arranged in a single row. In this case, the longitudinal direction is defined as a direction in which the plurality of receptacle contacts 7 are adjacent to each other.

Each of the receptacle auxiliary fittings 8 is made of metal, and is arranged at each end portion of the receptacle housing 6 in the longitudinal direction as shown in FIGS. 3 and 4.

Figure 6:
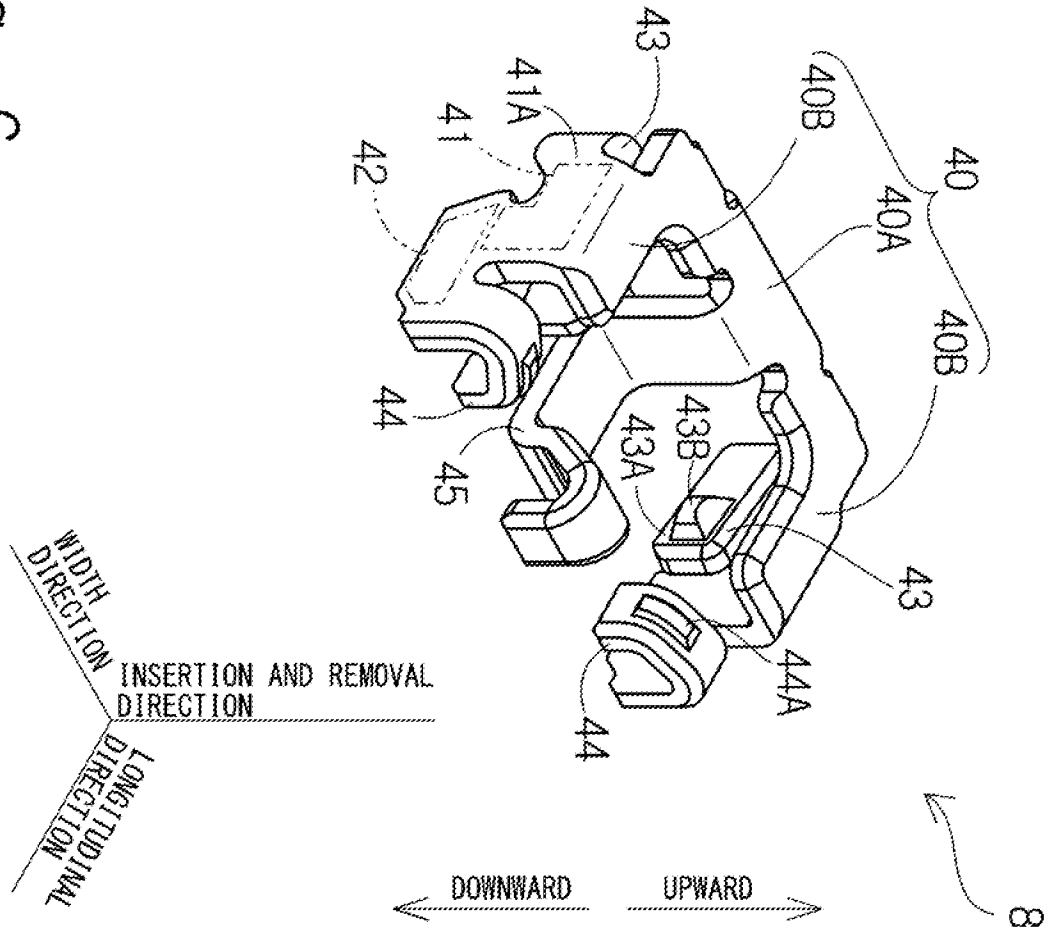
FIG. 6 is a perspective view of a receptacle auxiliary fitting.
Figure 7:
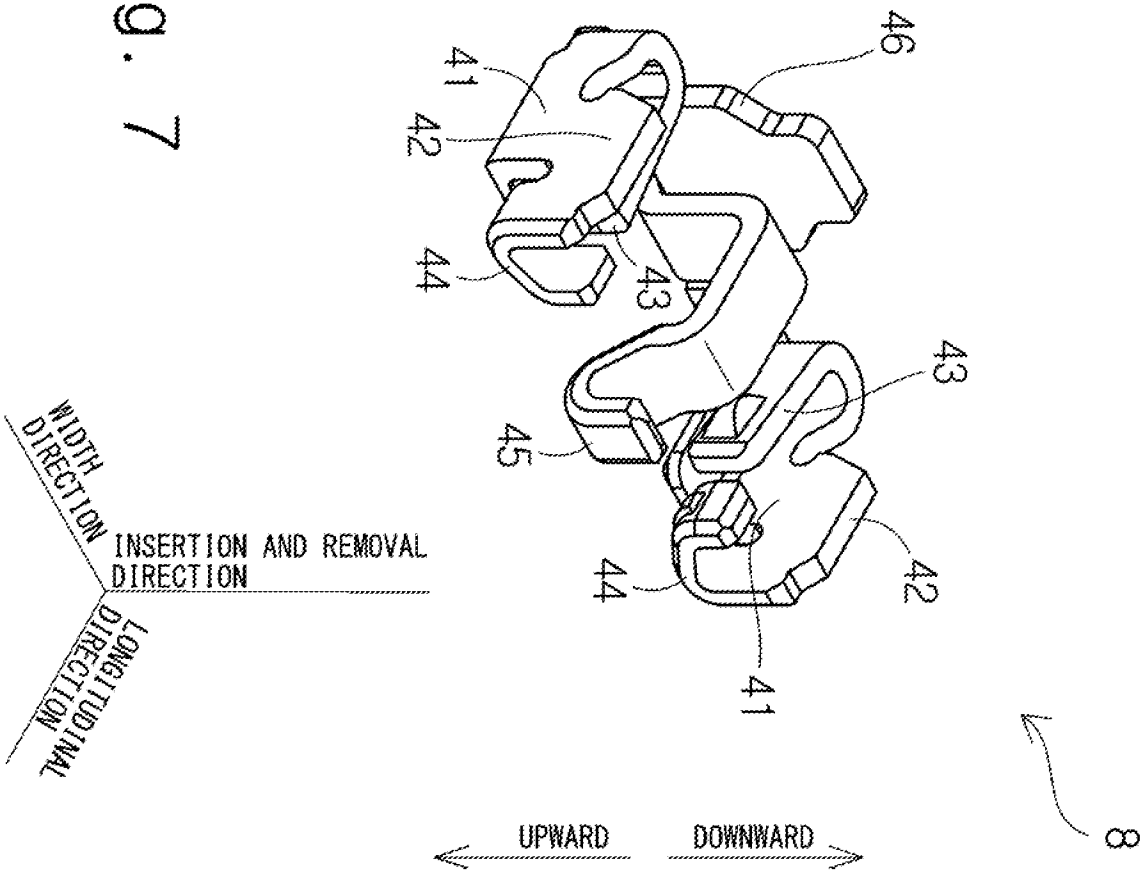
FIG. 7 is a perspective view of the receptacle auxiliary fitting from another angle.

As shown in FIGS. 6 and 7, each of the receptacle auxiliary fittings 8 includes a receptacle upper-surface protecting portion 40 (a protecting portion), two receptacle side-wall facing portions 41, two receptacle press-fitting portions 42, two receptacle electrical connecting portions 43 (second electrical connecting portions), two receptacle mating lock portions 44 (second mating lock portions), a receptacle tongue portion 45, and a receptacle soldering portion 46.

The receptacle upper-surface protecting portion 40 protects the receptacle-auxiliary-fitting holding portion 25 shown in FIG. 4, and is formed in a U-shape opened toward the island portion 21 shown in FIG. 4 in plan view. Specifically, the receptacle upper-surface protecting portion 40 includes an upper-surface protecting end-portion 40A and two upper-surface protecting side-portions 40B. The upper-surface protecting end-portion 40A faces the upper surface 26A of the receptacle-auxiliary-fitting holding end-portion 26 shown in FIG. 5 in the insertion and removal direction to protect the upper surface 26A. Each of the upper-surface protecting side-portions 40B faces the upper surface 27A of each of the receptacle-auxiliary-fitting holding side-portions 27 shown in FIG. 5 in the insertion and removal direction to protect the upper surface 27A. Each of the upper-surface protecting side-portions 40B further faces each of the receptacle electrical connecting portions 43 in the insertion and removal direction to protect each of the receptacle electrical connecting portions 43.

Each of the receptacle side-wall facing portions 41 extends downward from each of the upper-surface protecting side-portions 40B of the receptacle upper-surface protecting portion 40, is arranged outwardly with respect to each of the receptacle-auxiliary-fitting holding side-portions 27 shown in FIG. 5, and faces each of the receptacle-auxiliary-fitting holding side-portions 27 in the width direction.

Each of the receptacle press-fitting portions 42 fixes the receptacle auxiliary fitting 8 to the receptacle housing 6, projects downward from the lower end of each of the receptacle side-wall facing portions 41, and is press-fitted into each of the receptacle-auxiliary-fitting press-fitting grooves 30 shown in FIG. 5.

Each of the receptacle electrical connecting portions 43 is electrically connected to each of the plug auxiliary fittings 11 of the plug connector 5, and is held by each of the receptacle side-wall facing portions 41 in a cantilever manner. Specifically, each of the receptacle electrical connecting portions 43 is formed by being bent inward by about 170 degrees from end portion 41A of each of the receptacle side-wall facing portions 41 in the longitudinal end direction. In other words, each of the receptacle electrical connecting portions 43 extends from the end portion 41A of each of the receptacle side-wall facing portions 41 in the longitudinal center direction in a cantilever manner. That is, each of the receptacle electrical connecting portions 43 extends from the end portion 41A of each of the receptacle side-wall facing portions 41 toward each of the receptacle mating lock portions 44 in a cantilever manner. Each of the receptacle electrical connecting portions 43 is arranged inwardly with respect to each of the receptacle side-wall facing portions 41. Thus, each of the receptacle side-wall facing portions 41 and each of the receptacle electrical connecting portions 43 form a U-shape opened in the longitudinal center direction in bottom view shown in FIG. 7. Each of the receptacle side-wall facing portions 41 and each of the receptacle electrical connecting portions 43 are connected to each other via each of the receptacle-contact-portion accommodating slits 28 shown in FIG. 5. A free end portion 43A of each of the receptacle electrical connecting portions 43 is formed with an electrical contact portion 43B projecting inward.

Each of the receptacle mating lock portions 44 cooperates with each of the plug auxiliary fittings 11 of the plug connector 5 to perform the mating lock function, and is held by each of the receptacle press-fitting portions 42 in a cantilever manner. Specifically, each of the receptacle mating lock portions 44 forms a U-shape opened downward, and is formed by being bent inward by about 180 degrees from each of the receptacle press-fitting portions 42. Each of the receptacle press-fitting portions 42 is formed with a lock projection portion 44A projecting inward.

The receptacle tongue portion 45 guides the plug connector 5 to be mated with the receptacle connector 4, and extends from the upper-surface protecting end-portion 40A in the longitudinal center direction. Specifically, the receptacle tongue portion 45 forms a U-shape opened upward to receive the plug connector 5.

The receptacle soldering portion 46 shown in FIG. 7 is solderable to the receptacle side board 2, extends downward from the upper-surface protecting end-portion 40A shown in FIG. 6, and is accommodated in the auxiliary-fitting inserting groove 31 shown in FIG. 5.

Each of the receptacle auxiliary fittings 8 can be manufactured by punching and bending a metal plate, but is not limited thereto. Each of the receptacle auxiliary fittings 8 is attached to the receptacle housing 6 by press-fitting each of the receptacle press-fitting portions 42 in each of the receptacle-auxiliary-fitting press-fitting grooves 30, but is not limited thereto.

As shown in FIG. 6, each of the receptacle electrical connecting portions 43 is configured to be more flexible than each of the receptacle mating lock portions 44. That is, the electrical contact portion 43B of each of the receptacle electrical connecting portions 43 is more easily elastically displaced than the lock projection portion 44A of each of the receptacle mating lock portions 44. Thus, each of the receptacle electrical connecting portions 43 also performs a slight mating lock function, but the function is much weaker than the mating lock function of each of the receptacle mating lock portions 44. Thus, each of the receptacle electrical connecting portions 43 does not wear the plug auxiliary fitting 11 to generate metallic wear debris when the connector is inserted and removed, and contributes to stable electrical connection at each of the receptacle electrical connecting portions 43.

In addition, as shown in FIG. 6, each of the receptacle electrical connecting portions 43 and each of the receptacle mating lock portions 44 are adjacent to each other in the longitudinal direction. Then, each of the receptacle electrical connecting portions 43 is arranged to be closer to the longitudinal end direction side than each of the receptacle mating lock portions 44 is, that is, to be farther from the plurality of receptacle contacts 7 than each of the receptacle mating lock portions 44 is in the longitudinal direction.

(Plug Connector 5)

Next, with reference to FIGS. 8 to 12, the plug connector 5 will be specifically described.

As shown in FIGS. 8 and 9, the plug connector 5 includes, as described above, the plug housing 9, the plurality of plug contacts 10, and the two plug auxiliary fittings 11.

As shown in FIG. 9, the plug housing 9 is made of insulation resin, and is formed to be elongated in the longitudinal direction. The plug housing 9 includes a bottom wall 50 and a peripheral wall 51.

The bottom wall 50 is a wall portion having a rectangular shape in plan view, and extends in the longitudinal direction. The thickness direction of the bottom wall 50 is equal to the insertion and removal direction.

The peripheral wall 51 projects from the rim of the bottom wall 50 to have a rectangular annular shape in plan view. Thus, inside the peripheral wall 51, an island-portion accommodating space 52 is formed.

The peripheral wall 51 includes two plug-contact holding portions 53 and two plug-auxiliary-fitting holding portions 54.

Each of the plug-contact holding portions 53 holds three plug contacts 10. The two plug-contact holding portions 53 face each other in the width direction.

Each of the plug-auxiliary-fitting holding portions 54 holds each of the plug auxiliary fittings 11, and is adjacent to each of the plug-contact holding portions 53 in the longitudinal direction.

Figure 10:
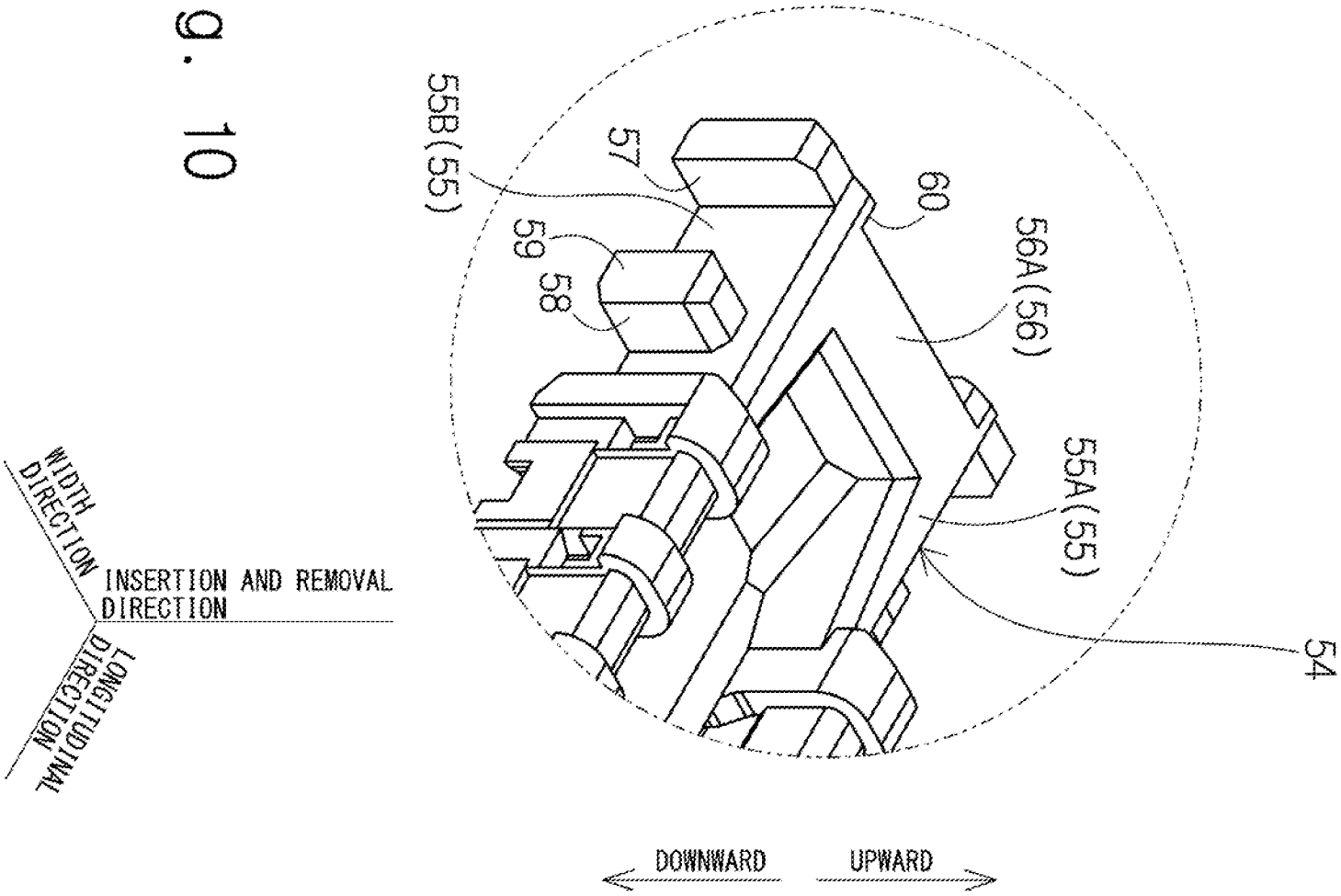
FIG. 10 is an enlarged partial perspective view of a plug housing.

As shown in FIG. 10, each of the plug-auxiliary-fitting holding portions 54 includes two plug-auxiliary-fitting holding side-portions 55 facing each other in the width direction, and a plug-auxiliary-fitting holding end-portion 56 coupling the two plug-auxiliary-fitting holding side-portions 55, and they form a U-shape opened in the longitudinal center direction in plan view.

Each of the plug-auxiliary-fitting holding side-portions 55 is formed with a plug connecting-portion accommodating groove 57 and a plug lock-portion accommodating groove 58. The plug connecting-portion accommodating groove 57 and the plug lock-portion accommodating groove 58 are formed to be adjacent to each other in the longitudinal direction. The plug connecting-portion accommodating groove 57 and the plug lock-portion accommodating groove 58 are arranged in the longitudinal center direction in this recited order. In addition, each of the plug-auxiliary-fitting holding side-portions 55 includes a partition wall 59 partitioning the plug connecting-portion accommodating groove 57 and the plug lock-portion accommodating groove 58 in the longitudinal direction. The plug-auxiliary-fitting holding end-portion 56 is formed with a guide-portion accommodating groove 60. Each of the plug-auxiliary-fitting holding side-portions 55 includes an upper surface 55A and a side surface 55B facing outward. Similarly, the plug-auxiliary-fitting holding end-portion 56 includes an upper surface 56A.

Returning back to FIG. 8, the plurality of plug contacts 10 are made of metal, and are arranged in two rows similarly to the plurality of receptacle contacts 7 shown in FIG. 3. The plug contacts 10 belonging to one of the two rows are arranged at one of the two plug-contact holding portions 53 of the plug housing 9 as shown in FIGS. 8 and 9.

Each of the plug contacts 10 can be manufactured by punching and bending a metal plate, but is not limited thereto. Each of the plug contacts 10 is integrated with the plug housing 9 by insert-molding, but is not limited thereto, and may be attached to the plug housing 9 by press-fitting.

Note that, the plurality of plug contacts 10 are arranged in two rows in the present embodiment, but are not limited thereto. Similarly to the above receptacle contacts 7, the plurality of plug contacts 10 may be arranged in a single row.

Each of the plug auxiliary fittings 11 is made of metal, and is arranged at each end portion of the plug housing 9 in the longitudinal direction as shown in FIGS. 8 and 9.

Figure 11:
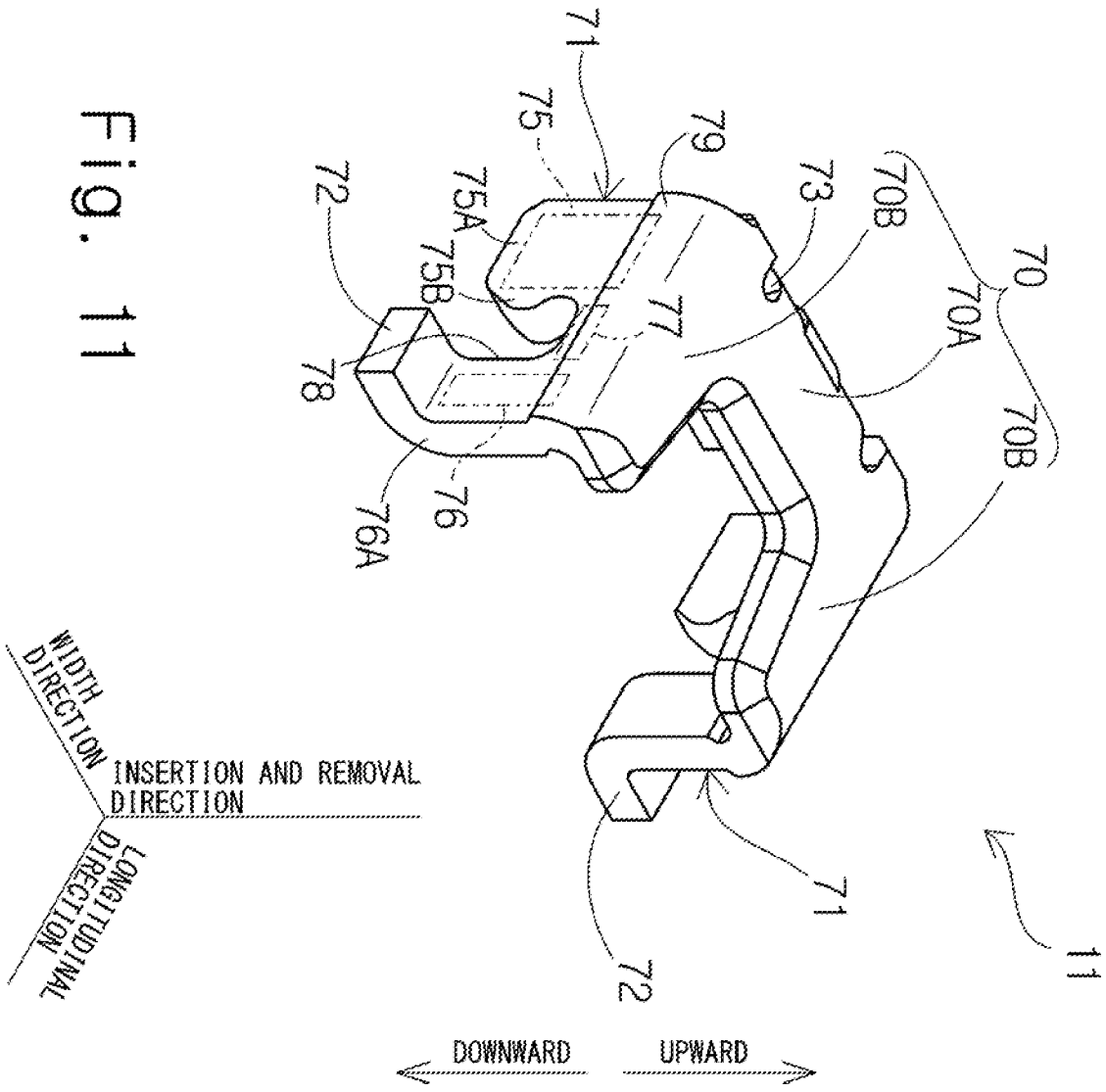
FIG. 11 is a perspective view of a plug auxiliary fitting.
Figure 12:
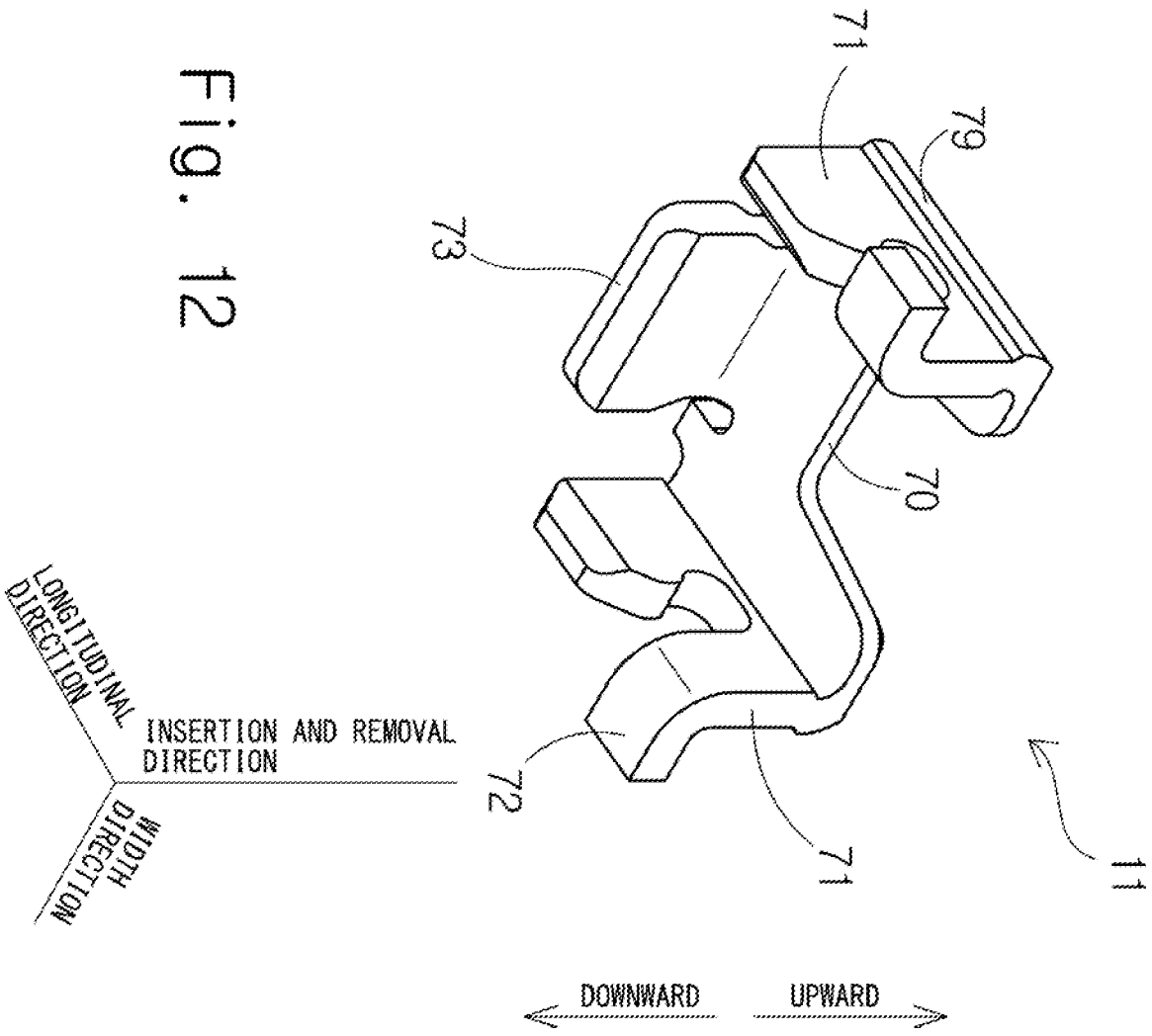
FIG. 12 is a perspective view of the plug auxiliary fitting from another angle.
Figure 13:
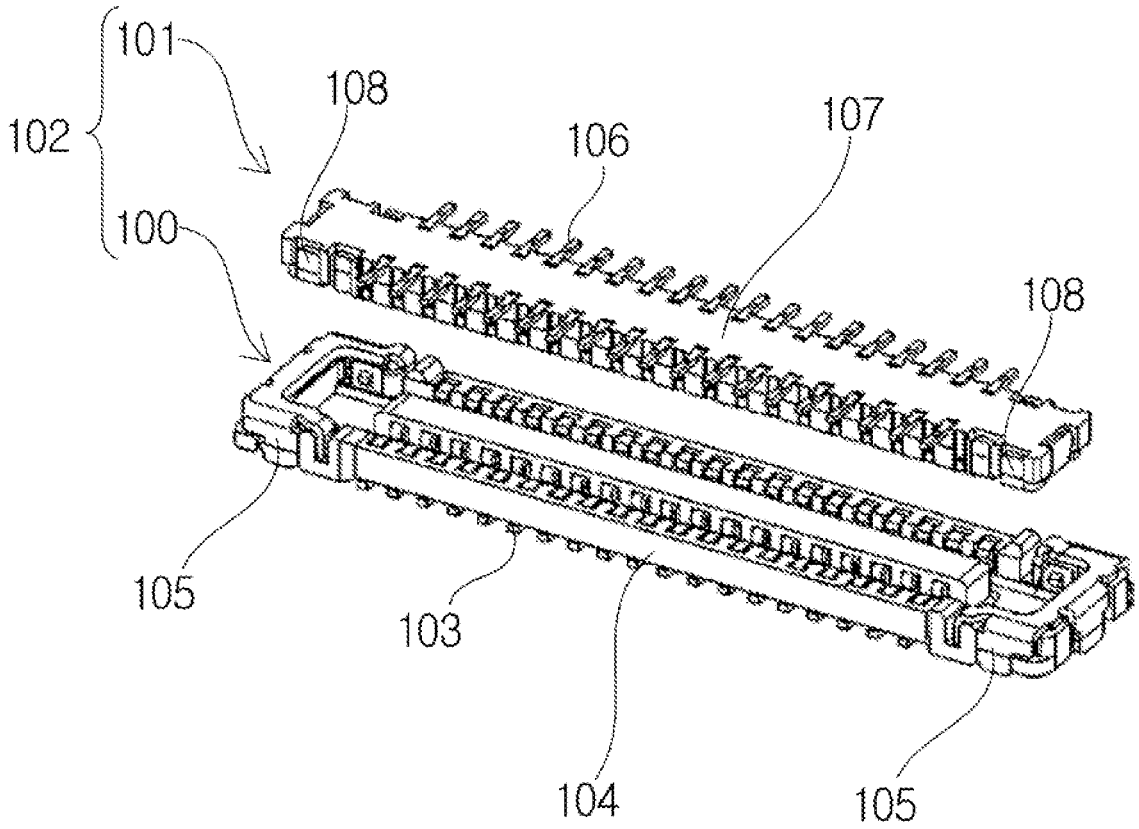
Fig. 13 (PRIOR ART)
FIG. 13 is a simplified diagram of FIG. 1 in Patent Literature 1.

As shown in FIGS. 11 and 12, each of the plug auxiliary fittings 11 includes a plug upper-surface protecting portion 70, two plug side-wall facing portions 71 (first side-surface facing portions), two soldering portions 72, and a guide portion 73.

The plug upper-surface protecting portion 70 protects the plug-auxiliary-fitting holding portion 54 shown in FIG. 9, and is formed in a U-shape opened toward the island-portion accommodating space 52 shown in FIG. 9 in plan view. Specifically, the plug upper-surface protecting portion 70 includes an upper-surface protecting end-portion 70A and two upper-surface protecting side-portions 70B. The upper-surface protecting end-portion 70A faces the upper surface 56A of the plug-auxiliary-fitting holding end-portion 56 of the plug-auxiliary-fitting holding portion 54 shown in FIG. 10 in the insertion and removal direction to protect the upper surface 56A. Each of the upper-surface protecting side-portions 70B faces the upper surface 55A of each of the plug-auxiliary-fitting holding side-portions 55 of the plug-auxiliary-fitting holding portion 54 shown in FIG. 10 in the insertion and removal direction to protect the upper surface 55A.

Each of the plug side-wall facing portions 71 extends downward from each of the upper-surface protecting side-portions 70B of the plug upper-surface protecting portion 70, is arranged outwardly with respect to each of the plug-auxiliary-fitting holding side-portions 55 shown in FIG. 10, and faces each of the plug-auxiliary-fitting holding side-portions 55 in the width direction. That is, each of the plug side-wall facing portions 71 faces the side surface 55B of each of the plug-auxiliary-fitting holding side-portions 55.

Each of the plug side-wall facing portions 71 includes a plug electrical connecting portion 75 (a first electrical connecting portion), a plug mating lock portion 76 (a first mating lock portion), and a coupling portion 77. The plug electrical connecting portion 75, the plug mating lock portion 76, and the coupling portion 77 are positioned in a single plane perpendicular to the width direction. All the thickness directions of the plug electrical connecting portion 75, the plug mating lock portion 76, and the coupling portion 77 are equal to the width direction.

The plug electrical connecting portion 75 is electrically connected to each of the receptacle auxiliary fittings 8 of the receptacle connector 4. A lower end portion 75A of the plug electrical connecting portion 75 is formed with a press-fitting projection portion 75B projecting in the longitudinal center direction.

The plug mating lock portion 76 cooperates with each of the receptacle auxiliary fittings 8 of the receptacle connector 4 to perform the mating lock function.

The coupling portion 77 couples the plug electrical connecting portion 75 with the plug mating lock portion 76 in the longitudinal direction.

The plug electrical connecting portion 75, the coupling portion 77, and the plug mating lock portion 76 are arranged in the longitudinal center direction in this recited order.

Each of the plug side-wall facing portions 71 is formed with a notch 78 (gap) opened downward between the plug electrical connecting portion 75 and the plug mating lock portion 76 in the longitudinal direction. The notch 78 is formed below the coupling portion 77. The notch 78 is formed to be adjacent to the coupling portion 77 in the insertion and removal direction. Thus, the notch 78 does not separate the plug side-wall facing portion 71 into two in the longitudinal direction. However, instead of this, the coupling portion 77 may be omitted, and the notch 78 may separate the plug side-wall facing portion 71 into two in the longitudinal direction.

The plug side-wall facing portion 71 is formed with a lock portion 79 for cooperating with the receptacle connector 4 to perform the mating lock function. In the present embodiment, the lock portion 79 is formed as a projection portion projecting outward. However, the lock portion 79 is not limited thereto as long as it has a form capable of cooperating with the receptacle connector 4 to perform the mating lock function, and may be a recess or a hole. The lock portion 79 is formed on at least the plug mating lock portion 76. In the present embodiment, the lock portion 79 is further formed on the plug electrical connecting portion 75 and the coupling portion 77. The lock portion 79 is formed straight over the plug mating lock portion 76, the coupling portion 77, and the plug electrical connecting portion 75 along the longitudinal direction in a seamless manner. However, the lock portion 79 may not be formed on the plug electrical connecting portion 75 and the coupling portion 77, but may be formed only on the plug mating lock portion 76. The lock portion 79 is formed apart from the notch 78 and disposed upwardly with respect to the notch 78.

Each of the soldering portions 72 is soldered to the plug-connector mounting surface 3A of the plug-side board 3 to fix the plug connector 5 to the plug-connector mounting surface 3A of the plug-side board 3. Each of the soldering portions 72 is formed to extend outward from a lower end portion 76A of the plug mating lock portion 76 of each of the plug side-wall facing portions 71. However, instead of this, the lower end portion 76A of the plug mating lock portion 76 itself may be the soldering portion to be soldered to the plug-connector mounting surface 3A of the plug-side board 3.

The guide portion 73 guides the plug connector 5 to be mated with the receptacle connector 4, and is formed to extend downward from the upper-surface protecting end-portion 70A.

Each of the plug auxiliary fittings 11 can be manufactured by punching and bending a metal plate, but is not limited thereto. Each of the plug auxiliary fittings 11 is attached to the plug housing 9 by press-fitting the plug electrical connecting portion 75 of each of the plug side-wall facing portions 71 into each of the plug connecting-portion accommodating grooves 57, but is not limited thereto.

In addition, the plug electrical connecting portion 75 and the plug mating lock portion 76 of each of the plug side-wall facing portions 71 are arranged side by side in the longitudinal direction. Then, the plug electrical connecting portion 75 is arranged to be closer to the longitudinal end direction side than the plug mating lock portion 76 is, that is, to be farther from the plurality of plug contacts 10 than the plug mating lock portion 76 is in the longitudinal direction.

(Mating of Connector Assembly 1)

In order for the plug connector 5 to be mated with the receptacle connector 4, first, the plug connector 5 is moved in the mating direction from the state in which the plug connector 5 is facing the receptacle connector 4 in the insertion and removal direction as shown in FIG. 2.

Then, the guide portion 73 of each of the plug auxiliary fittings 11 of the plug connector 5 shown in FIG. 11 cooperates with the receptacle tongue portion 45 of each of the receptacle auxiliary fittings 8 of the receptacle connector 4 shown in FIG. 6 to guide the plug connector 5 to the receptacle connector 4 in the longitudinal direction.

Then, when the electrical contact portion 43B of the receptacle electrical connecting portion 43 of each of the receptacle auxiliary fittings 8 shown in FIG. 6 comes into contact with the lock portion 79 of each of the plug auxiliary fitting 11 shown in FIG. 11, the cantilever receptacle electrical connecting portion 43 is elastically deformed outward. In this state, when the plug connector 5 is further moved in the mating direction, the electrical contact portion 43B shown in FIG. 6 crosses over the lock portion 79 shown in FIG. 11, and the receptacle electrical connecting portion 43 shown in FIG. 6 is elastically returned inward, comes into contact with the plug electrical connecting portion 75 shown in FIG. 11, and is urged toward the plug electrical connecting portion 75. This achieves the electrical contact between each of the receptacle auxiliary fittings 8 shown in FIG. 6 and each of the plug auxiliary fittings 11 shown in FIG. 11.

Meanwhile, when the lock projection portion 44A of the receptacle mating lock portions 44 shown in FIG. 6 comes into contact with the lock portion 79 of each of the plug auxiliary fittings 11 shown in FIG. 11, the cantilever receptacle mating lock portion 44 is elastically deformed outward. In this state, when the plug connector 5 is further moved in the mating direction, the lock projection portion 44A shown in FIG. 6 crosses over the lock portion 79 shown in FIG. 11, and the receptacle mating lock portion 44 shown in FIG. 6 is elastically returned inward. Incidentally, the receptacle mating lock portion 44 shown in FIG. 6 is designed to be less flexible outward than the receptacle electrical connecting portion 43. In other words, the receptacle mating lock portion 44 shown in FIG. 6 is designed to have a higher rigidity than the receptacle electrical connecting portion 43. Thus, the receptacle mating lock portion 44 shown in FIG. 6 perform a powerful mating lock function.

(Removal of the Connector Assembly 1)

In order for the plug connector 5 to be removed from the receptacle connector 4, the receptacle side board 2 is held by one hand, and the plug-side board 3 is pulled in the removing direction by the other hand. In this manner, the receptacle electrical connecting portion 43 and the receptacle mating lock portion 44 shown in FIG. 6 come into contact with the lock portion 79 and are elastically deformed outward, and the receptacle electrical connecting portion 43 and the receptacle mating lock portion 44 crosses over the lock portion 79. Then, the plug connector 5 is removable from the receptacle connector 4.

The suitable embodiments of the present disclosure have been described above, and the above embodiments have the following features.

The connector assembly 1 includes the plug connector 5 (a first connector) mountable on the plug-side board 3 (a first circuit board) and the receptacle connector 4 (a second connector) mountable on the receptacle side board 2 (a second circuit board). The plug connector 5 includes the plurality of plug contacts 10 (first contacts), the plug housing 9 (a first housing) holding the plurality of plug contacts 10, the plug auxiliary fitting 11 (a first auxiliary fitting) attached to the plug housing 9. The receptacle connector 4 includes the plurality of receptacle contacts 7 (second contacts), the receptacle housing 6 (a second housing) holding the plurality of receptacle contacts 7, the receptacle auxiliary fitting 8 (a second auxiliary fitting) attached to the receptacle housing 6. Mating the plug connector 5 with the receptacle connector 4 makes each of the plug contacts 10 come into electrical contact with each of the receptacle contacts 7.

As shown in FIGS. 10 to 12, the plug auxiliary fitting 11 includes the plug side-wall facing portion 71 (a first side-surface facing portion) facing the side surface 55B of the plug housing 9. The plug side-wall facing portion 71 includes the plug electrical connecting portion 75 (a first electrical connecting portion) capable of coming into electrical contact with the receptacle auxiliary fitting 8, and the plug mating lock portion 76 (a first mating lock portion) that cooperates with the receptacle auxiliary fitting 8 to prevent the mating state between the plug connector 5 and the receptacle connector 4 from being released. The plug electrical connecting portion 75 and the plug mating lock portion 76 are, in the direction parallel to the plug-connector mounting surface 3A (a first connector mounting surface) of the plug-side board 3, adjacent to each other with the notch 78 (gap) opened toward the plug-connector mounting surface 3A of the plug-side board 3 interposed therebetween. The plug mating lock portion 76 is provided with the soldering portion 72 solderable to the plug-connector mounting surface 3A of the plug-side board 3.

With this configuration, since the plug mating lock portion 76 is provided with the soldering portion 72, it is possible for the plug mating lock portion 76 to stably perform the mating lock function. In addition, the notch 78 makes it difficult for solder flux crawling up the soldering portion 72 to reach the plug electrical connecting portion 75, thus stable electrical connection at the plug electrical connecting portion 75 is achieved.

In addition, as shown in FIG. 11, the plug electrical connecting portion 75 is farther from the plurality of plug contacts 10 than the plug mating lock portion 76 is. With this configuration, the degree of freedom in designing the plug electrical connecting portion 75 is increased.

In addition, as shown in FIGS. 6 and 7, the receptacle auxiliary fitting 8 includes the receptacle electrical connecting portion 43 (a second electrical connecting portion) capable of coming into electrical contact with the plug electrical connecting portion 75, and the receptacle mating lock portion 44 (a second mating lock portion) that cooperates with the plug mating lock portion 76 to prevent the mating state between the plug connector 5 and the receptacle connector 4 from being released. The receptacle electrical connecting portion 43 extends toward the receptacle mating lock portion 44 in a cantilever manner. At the free end portion 43A of the receptacle electrical connecting portion 43, the electrical contact portion 43B capable of coming into electrical contact with the plug electrical connecting portion 75 is arranged. With this configuration, the electrical contact portion 43B of the receptacle electrical connecting portion 43 can be arranged near the receptacle mating lock portion 44, and this contributes to decrease in the size of the connector assembly 1 in the longitudinal direction.

In addition, as shown in FIGS. 5 and 6, the receptacle auxiliary fitting 8 includes, in the insertion and removal direction, the receptacle upper-surface protecting portion 40 covering the receptacle housing 6 and the receptacle electrical connecting portion 43. With this configuration, it is possible to prevent the damage of the receptacle housing 6 and the receptacle electrical connecting portion 43 when the connectors are mated. Furthermore, the plug electrical connecting portion 75 is farther from the plurality of plug contacts 10 than the plug mating lock portion 76 is, in response the receptacle electrical connecting portion 43 is farther from the plurality of receptacle contacts 7 than the receptacle mating lock portion 44 is, thus the receptacle upper-surface protecting portion 40 easily covers the receptacle electrical connecting portion 43 and the receptacle housing 6.

In addition, as shown in FIGS. 11 and 12, the plug side-wall facing portion 71 includes the notch 78 opened toward the plug-connector mounting surface 3A of the plug-side board 3 to form a U-shape opened toward the plug-connector mounting surface 3A of the plug-side board 3. The plug side-wall facing portion 71 further includes the coupling portion 77 coupling the plug electrical connecting portion 75 with the plug mating lock portion 76. With this configuration, compared to the case where the notch 78 separates the plug side-wall facing portion 71 into two, it is easier to manage the relative positional dimensions between the plug electrical connecting portion 75 and the plug mating lock portion 76 in the width direction.

In addition, as shown in FIG. 11, the plug mating lock portion 76 is formed with the lock portion 79 that is a projection. However, instead of this, the lock portion 79 may be a recess or a hole.

In addition, as shown in FIG. 11, the lock portion 79 is formed over the plug mating lock portion 76, the coupling portion 77, and the plug electrical connecting portion 75 in a seamless manner.

In addition, as shown in FIG. 11, the lock portion 79 is formed apart from the notch 78.

It is noted that one of the two receptacle auxiliary fittings 8 shown in FIG. 3 may be omitted, and one of the two plug auxiliary fittings 11 shown in FIG. 4 may be omitted.

The suitable embodiments of the present disclosure have been described above. In the following, Patent Literature 1 and the like are supplementarily described.

Figure 14:
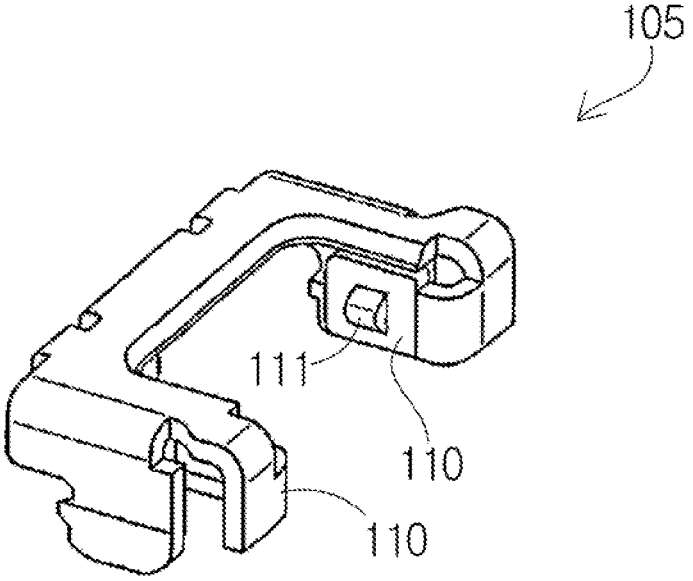
Fig. 14 (PRIOR ART)
FIG. 14 is a simplified diagram of FIG. 3D in Patent Literature 1.
Figure 15:
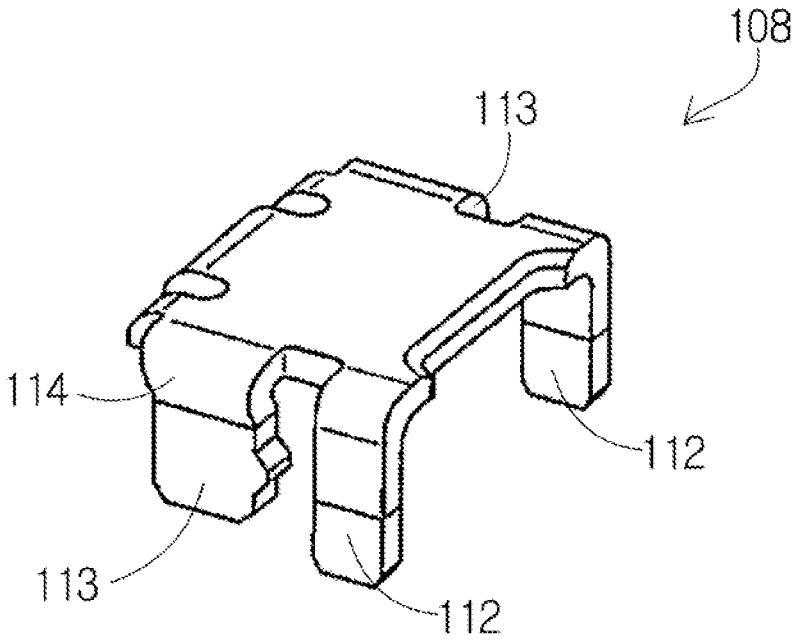
Fig. 15 (PRIOR ART)
FIG. 15 is a simplified diagram of FIG. 6D in Patent Literature 1.

(1) As shown in FIGS. 14 and 15, in the mating state of the connector, the inner-surface portion 110 of the receptacle fitting 105 faces the second outer-surface portion 113 of the plug fitting 108. Meanwhile, the receptacle fitting 105 has no member facing the first outer-surface portion 112 of the plug fitting 108. Thus, although the first outer-surface portion 112 is changed in any shape, the first outer-surface portion 112 cannot perform the mating lock function.

(2) If a projection for performing the mating lock function is provided near the base of the cantilever inner-surface portion 110 in FIG. 14, the behavior of the raised portion 111 when the projection performs the mating lock function cannot be controlled, and the electrical contact at the raised portion 111 becomes unstable.

(3) The second outer-surface portion 113 that achieves the electrical connection is preferably arranged near the contacts for the convenience of wiring. Thus, to arrange so that a portion for achieving electrical connection is farther from the contacts than the portion for performing the mating lock function is contrary to the common general knowledge.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A connector assembly comprising:

a first connector comprising a plurality of first contacts, a first housing holding the plurality of first contacts, and a first auxiliary fitting attached to the first housing, the first connector being mountable on a first circuit board; and a second connector comprising a plurality of second contacts, a second housing holding the plurality of second contacts, and a second auxiliary fitting attached to the second housing, the second connector being mountable on a second circuit board, wherein the first connector is mated with the second connector to bring each first contact into electrical contact with each second contact, the first auxiliary fitting includes a first side-surface facing portion facing a side surface of the first housing, the first side-surface facing portion includes:

a first electrical connecting portion configured to come into electrical contact with the second auxiliary fitting; and a first mating lock portion that cooperates with the second auxiliary fitting to prevent a mating state between the first connector and the second connector from being released, the first electrical connecting portion and the first mating lock portion are positioned in a single plane, the first electrical connecting portion and the first mating lock portion are, in a direction parallel to a first connector mounting surface of the first circuit board, adjacent to each other with a gap opened toward the first connector mounting surface of the first circuit board interposed therebetween, and the first mating lock portion is provided with a soldering portion solderable to the first connector mounting surface of the first circuit board.

2. The connector assembly according to claim 1, wherein the first electrical connecting portion is farther from the plurality of first contacts than the first mating lock portion is.

3. The connector assembly according to claim 2, wherein the second auxiliary fitting includes:

a second electrical connecting portion configured to come into electrical contact with the first electrical connecting portion; and a second mating lock portion that cooperates with the first mating lock portion to prevent the mating state between the first connector and the second connector from being released, the second electrical connecting portion extends toward the second mating lock portion in a cantilever manner, and the second electrical connecting portion includes a free end portion at which an electrical contact portion configured to come into electrical contact with the first electrical connecting portion is arranged.

4. The connector assembly according to claim 3, wherein the second auxiliary fitting includes a protecting portion covering the second electrical connecting portion in a direction perpendicular to a second connector mounting surface of the second circuit board.

5. The connector assembly according to claim 3, wherein the second auxiliary fitting includes a protecting portion covering the second housing and the second electrical connecting portion in a direction perpendicular to a second connector mounting surface of the second circuit board.

6. The connector assembly according to claim 1, wherein due to the gap opened toward the first connector mounting surface of the first circuit board, the first side-surface facing portion is formed in a U-shape that opens toward the first connector mounting surface of the first circuit board, and the first side-surface facing portion further includes a coupling portion coupling the first electrical connecting portion with the first mating lock portion.

7. The connector assembly according to claim 6, wherein the first mating lock portion is formed with a lock portion including at least one of a projection, a recess, or a hole.

8. The connector assembly according to claim 7, wherein the lock portion is formed over the first mating lock portion, the coupling portion, and the first electrical connecting portion in a seamless manner.

9. The connector assembly according to claim 7, wherein the lock portion is formed apart from the gap.

10. A connector assembly having a longitudinal direction and a width direction that is perpendicular to the longitudinal direction, the connector assembly comprising:

a first connector comprising a plurality of first contacts, a first housing holding the plurality of first contacts, and a first auxiliary fitting attached to the first housing, the first connector being mountable on a first circuit board; and a second connector comprising a plurality of second contacts, a second housing holding the plurality of second contacts, and a second auxiliary fitting attached to the second housing, the second connector being mountable on a second circuit board, wherein the first connector is mated with the second connector to bring each first contact into electrical contact with each second contact, the first auxiliary fitting includes a first side-surface facing portion facing a side surface of the first housing in the width direction, the first side-surface facing portion includes:

a first electrical connecting portion configured to come into contact with the second auxiliary fitting and to form an electrical connection with the second auxiliary fitting; and a first mating lock portion that cooperates with the second auxiliary fitting to prevent a mating state between the first connector and the second connector from being released, the first electrical connecting portion and the first mating lock portion are, in a direction parallel to a first connector mounting surface of the first circuit board, adjacent to each other with a gap opened toward the first connector mounting surface of the first circuit board interposed therebetween, and the first mating lock portion is provided with a soldering portion solderable to the first connector mounting surface of the first circuit board.

* * * * *